US007011009B1

(12) United States Patent
Tomich

(10) Patent No.: US 7,011,009 B1
(45) Date of Patent: Mar. 14, 2006

(54) MAGNETICALLY ALIGNED HOLE PUNCH

(76) Inventor: Jennifer Lynne Tomich, 14 Willowby Way, Lynnfield, MA (US) 01940

( * ) Notice: Subject to any disclaimer, the term of this patent is extended or adjusted under 35 U.S.C. 154(b) by 0 days.

(21) Appl. No.: 10/707,132

(22) Filed: Nov. 21, 2003

(51) Int. Cl.
*B26F 1/14* (2006.01)

(52) U.S. Cl. ..... 83/696; 83/698.21; 29/465

(58) Field of Classification Search ..... 83/620, 83/684–689, 698.21; 248/206.5; 29/465
See application file for complete search history.

(56) References Cited

U.S. PATENT DOCUMENTS

| | | | | | |
|---|---|---|---|---|---|
| 1,540,860 | A | * | 6/1925 | Pobanz | 83/128 |
| 2,145,725 | A | * | 1/1939 | Jamieson | 30/366 |
| 2,600,254 | A | * | 6/1952 | Lysobey | 101/36 |
| 3,097,406 | A | * | 7/1963 | Yarborough | 24/3.7 |
| 3,683,499 | A | * | 8/1972 | Robinson, Jr. | 30/360 |
| 4,036,088 | A | | 7/1977 | Ruskin | 83/167 |
| 4,058,335 | A | * | 11/1977 | Abe | 292/251.5 |
| 4,428,098 | A | * | 1/1984 | Coker et al. | 24/30.5 R |
| 4,466,322 | A | | 8/1984 | Mori | 83/468 |
| 4,491,261 | A | * | 1/1985 | Mitsuhashi | 227/76 |
| 4,594,927 | A | * | 6/1986 | Mori | 83/620 |
| 4,791,843 | A | * | 12/1988 | Herrington et al. | 347/171 |
| 5,490,440 | A | | 2/1996 | Karlis | 83/599 |
| 5,501,128 | A | | 3/1996 | D'Amore | 83/599 |
| 5,730,038 | A | | 3/1998 | Evans | 83/686 |
| 5,730,098 | A | * | 3/1998 | Sasaki et al. | 123/198 DB |
| 6,000,139 | A | | 12/1999 | Chan | 30/358 |
| 6,439,093 | B1 | | 8/2002 | Davies | 83/687 |
| 6,663,331 | B1 | * | 12/2003 | Mori et al. | 412/39 |

* cited by examiner

*Primary Examiner*—Kenneth E. Peterson
*Assistant Examiner*—Carolyn Blake
(74) *Attorney, Agent, or Firm*—Mark P. White

(57) ABSTRACT

A punching device for punching paper and like sheet material contains an upper frame, a cooperating upper magnetic base supporting the upper frame, and a punch rod slideably disposed within the upper frame, and passing through a clearance hole formed in the upper magnetic base. A lower magnetic base contains a punch die. The lower magnetic base which magnetically aligns with the upper magnetic base when a paper sheet is disposed between the upper and lower magnetic bases, and the punch rod is then concentrically aligned with the punch die. This punching device can be used to punch a hole anywhere over the extent of the sheet, regardless of how far the hole is from any edge of the sheet.

14 Claims, 8 Drawing Sheets

MAGNETICALLY ALIGNED HOLE PUNCH

BACKGROUND OF INVENTION

Paper punches are well know in the art and are found in nearly every office which generates or handles documents.

Paper punches are commonly available in single hole varieties, in two and three hole varieties, and in multi-hole varieties which allow the user to adjust the distance between the various holes punched.

Almost all of these punches use the same basic punching tool; namely, one or more of a punch rod sharpened at the lower end, and a cooperating punch die which is coaxially aligned with the punch rod, and which receives the punch rod as it is pushed through the sheet being punched.

In addition, there is some means of applying a downward pressure to the punch rod, usually involving some kind of lever system to create mechanical advantage.

FIG. 1 shows a typical prior art punch. The punch rod 101 is retained by a coil spring 301. The punch die 140 resides in a lower assembly 120 and is coaxially aligned with the guide 280 which constrains the vertical movement of the punch rod. A handle 160 provides mechanical advantage to push down on the top of the punch rod.

The paper sheet to be punched is disposed in the space between the upper and lower parts of the punch. However, the paper cannot be inserted past the throat 144 of the punch. As a result, the maximum distance between the edge of the paper and the punch rod-die axis is constrained to a relatively small displacement, as may be seen by referring to this Figure.

Virtually all of the simple punches based on the principles stated above have the same shortcoming, that is, the inability to allow a user to punch holes near the center of a sheet. This shortcoming is a result of the necessity in prior art punches to provide a physical connection between the upper assembly of the punch, containing the punch rod, and the lower assembly, containing the punch die. As the distance between the punch rod-die axis to the throat becomes greater, the punch device becomes extended in size and must become increasingly bulkier and reinforced in order to support what is essentially a pair of cantilevered members having a moment arm equal to the distance from the throat to the punch rod-die axis.

The present invention provides a simple, compact punch which overcomes the inherent structural problems of prior art punches by omitting the physical connection between the upper and lower assemblies of the prior art punch, and instead provides alignment of the punch rod and punch die by means of magnetic alignment of these to elements.

SUMMARY OF INVENTION

It is an object of the present invention to provide a punch for paper or similar sheet material which can be used to punch holes anywhere over the entire extent of the sheet.

In accordance with a first aspect of the present invention a punching device includes an upper frame, a cooperating upper magnetic base supporting the upper frame, and a punch rod slideably disposed within the upper frame and passing through a clearance hole formed in the upper magnetic base and a lower magnetic base.

In accordance with a second aspect of the invention the lower base contains a punch die which magnetically aligns with the upper magnetic base when sheet material is disposed between the upper and lower magnetic bases.

In accordance with a third aspect of the invention, a lever handle is rotatably affixed to the upper frame and slideably engaged to the top of the punch rod.

In accordance with a fourth aspect of the invention the upper frame is itself magnetic, and is integrated with the upper magnetic base.

In accordance with a fifth aspect of the invention a spring is provided which maintains the punch rod in an upper position until a user applies a downward force to the top of the punch rod.

In accordance with a sixth aspect of the invention an oblong slot is formed within the lever handle.

In accordance with a seventh aspect of the invention the punch rod has one or more annular recesses formed in proximity with the top of the punch rod.

In accordance with an eighth aspect of the invention one of the annular recesses is captured within the oval slot of the lever handle, so that the punch rod will raise when the lever handle is raised, and lower when the lever handle is lowered.

In accordance with a ninth aspect of the invention a multi-hole version of punching device contains an upper assembly, an upper magnet affixed to the upper assembly, and a number of punch rods, each slideably disposed within the upper assembly, and passing through a clearance hole formed in the upper assembly and upper magnet.

In accordance with a tenth aspect of the invention the lower assembly contains a multiplicity of punch dies and a lower magnet affixed to the lower assembly which magnetically aligns with the upper assembly when the sheet material is disposed between the upper and lower assemblies.

In accordance with an eleventh aspect of the invention the upper frame of the multi-hole version is itself magnetic, and is integrated with the upper magnetic base.

In accordance with a twelfth aspect of the invention a lever handle is rotatably affixed to the upper assembly of the multi-hole version which slideably engages the top of the punch rods.

BRIEF DESCRIPTION OF DRAWINGS

These, and further features of the invention, may be better understood with reference to the accompanying specification and drawings depicting the preferred embodiment, in which.

DETAILED DESCRIPTION

The present invention is an apparatus which allows the user to punch one or more holes in a sheet of paper or similar material anywhere in the sheet.

Prior art paper punches include simple, single hole punches and multi-hole punches which punch holes only within an inch of the edge of one or several sheets, but do not permit the punching of holes farther from an edge.

The present invention, like prior art punches, contains a punch rod with a sharpened punch surface, which is disposed on the top of the sheet to be punched, and which mates with a die on the opposite side of the paper.

However, in the present invention there is no mechanical connection between the assembly holding the punch rod and the punch die. Rather, these two elements are maintained in alignment by magnetically aligning the two.

Single Punch Embodiments

Figure 4:
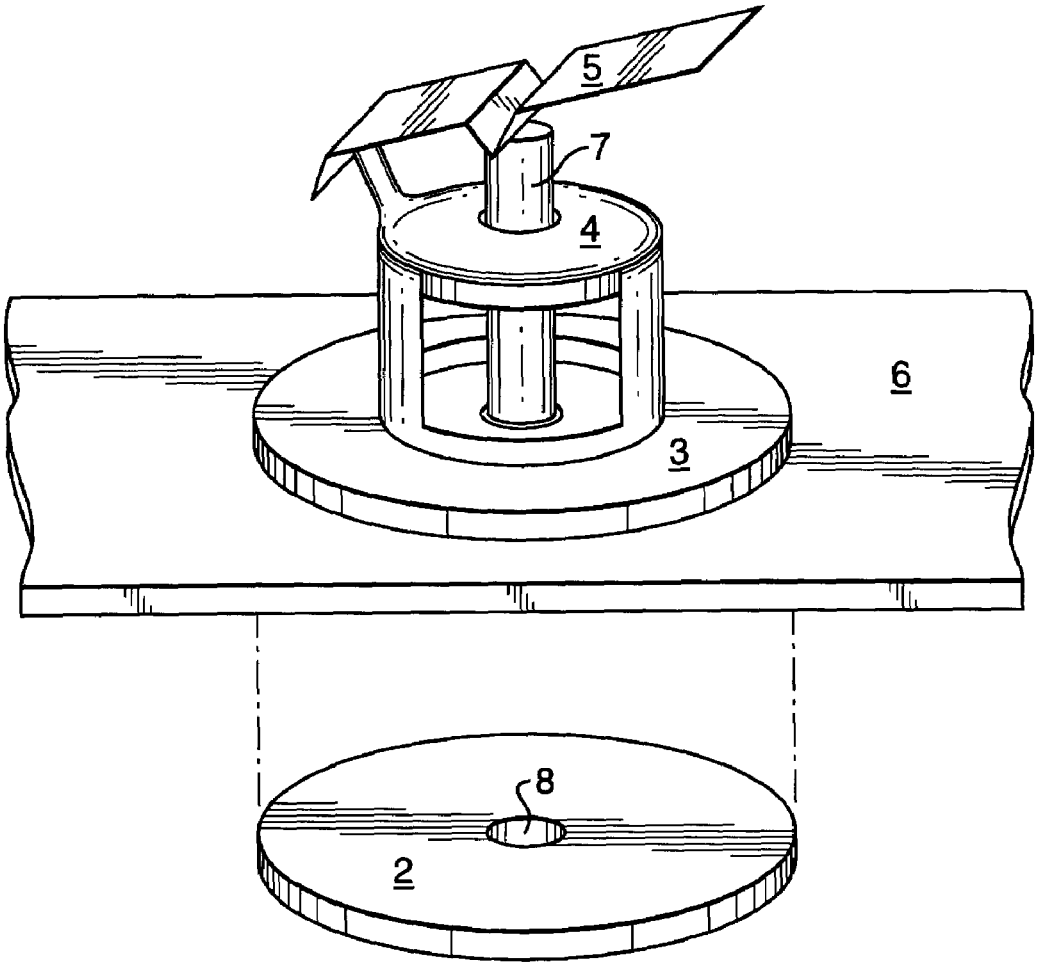
FIG. 4 depicts a perspective view of the single hole embodiment of the present invention.

The instant invention may be understood by first referring to FIG. 4. An upper frame 4 contains the punch rod 7 which performs the perforation of the sheet. The upper frame is rigidly affixed to an upper magnet 3 which is disposed at the upper surface of the sheet 6 to be punched. A lever handle 5 is affixed to the upper frame by means of a hinge assembly. The upper frame, upper magnet, and components mounted therein form an upper assembly.

A lower assembly is disposed beneath the sheet, and contains the punch die 8. The lower assembly contains a magnet 2 which aligns the lower assembly with the upper frame, so that the punch rod 7 will align with the punch die 8.

It has been determined by the applicant, as a result of testing with a model of the invention, that when the upper assembly is moved above the paper the lower assembly will follow beneath, and maintain the alignment of the punch die beneath the punch rod.

In a variation of this embodiment, the upper frame and upper magnet are merged into a single element by using a magnetic upper frame. It is well known that some materials, such as iron, nickel, cobalt, and combination of the above, commonly referred to as magnetizable metals, can themselves be magnetized while retaining the structural strength and ease of machining required for applications such as those required for use in the upper frame of the current invention.

Figure 1:
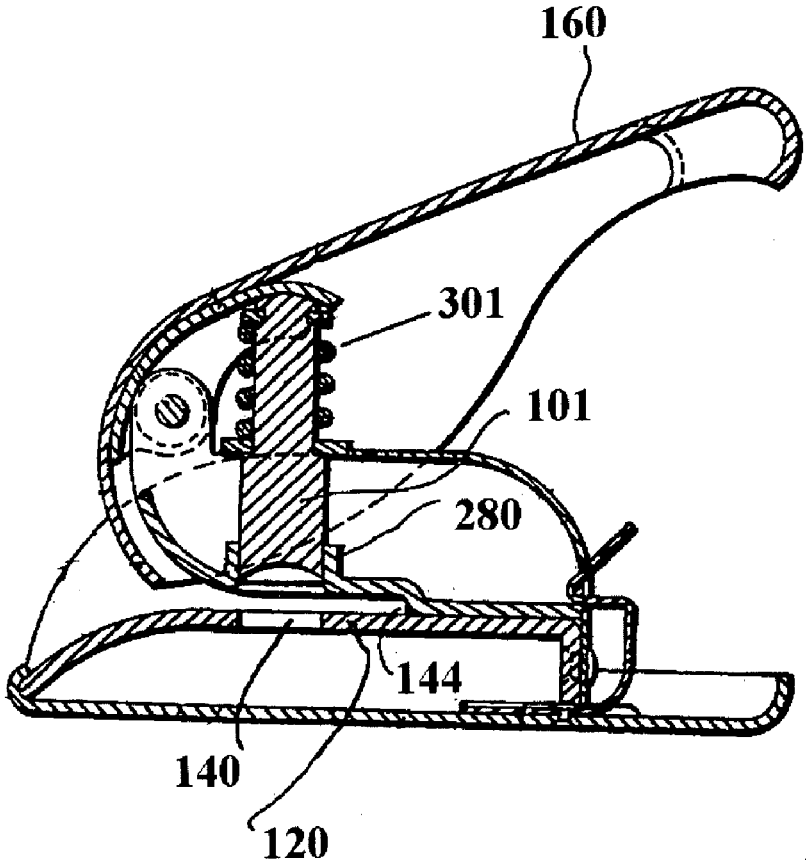
Fig. 1 (Prior Art)
FIG. 1 depicts a prior art paper hole punch.
Figure 2:
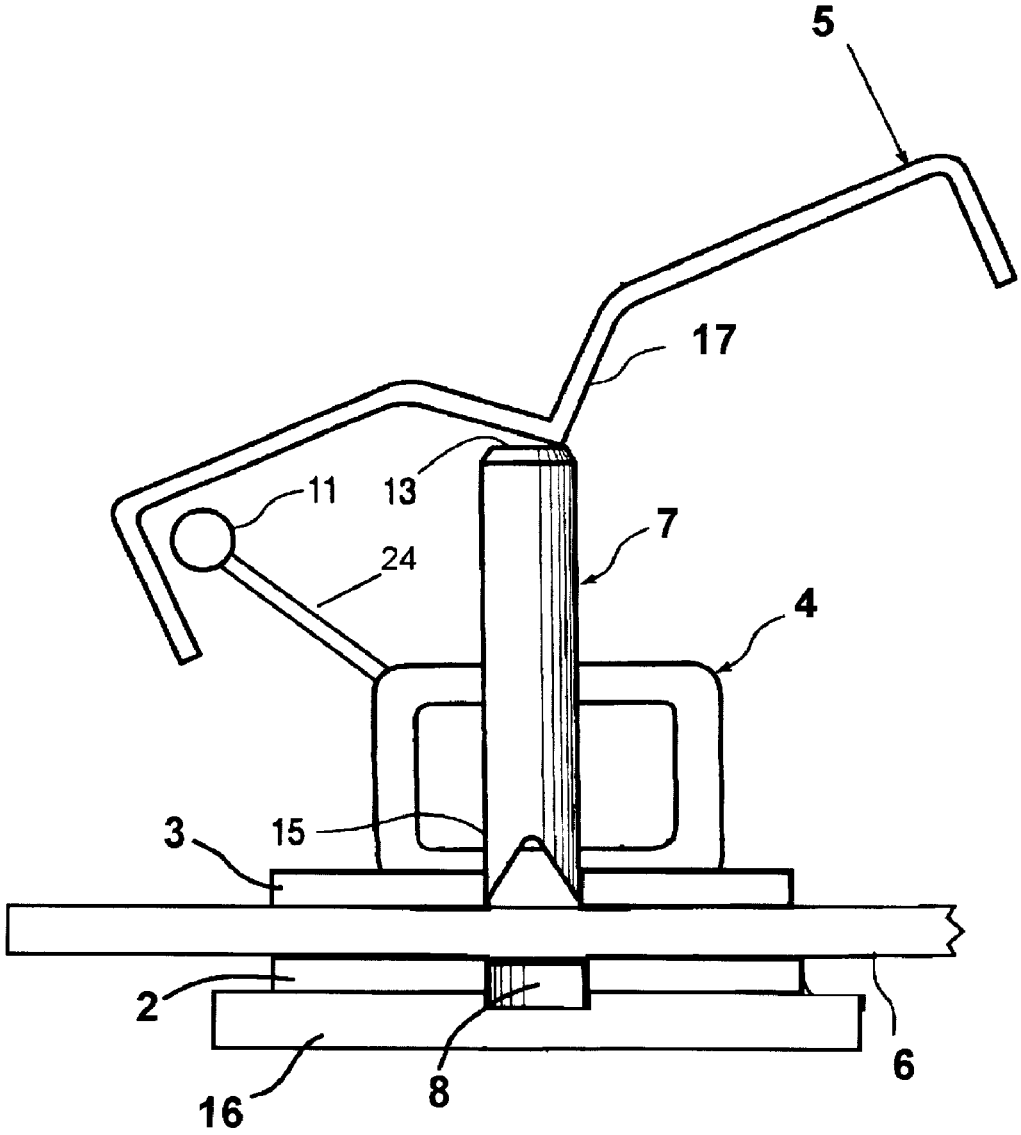
FIG. 2 depicts a front elevation view of the single hole embodiment of the present invention.

Referring now to FIG. 2, a side elevation view of the first embodiment is shown. The upper frame 4 is substantially cylindrical in shape and is rigidly affixed to the upper magnet 3 which is configured in the shape of a disk. The lower assembly 16 is disposed beneath a sheet of paper 6, and contains a lower magnet 2 which is rigidly affixed concentrically to the lower assembly. The punch die 8 is contained within the lower assembly.

It is seen that the upper and lower magnets are identical in shape. Further, both the punch rod and the punch die are disposed at the center of their respective, disk-shaped magnets.

The lever handle 5 is attached to the upper frame by means of a hinge 11, which is affixed to the upper frame by means of hinge arm 24. The top 13 of the punch rod 7 lies below the lever bearing surface 17, which provides a reduced cross section in contact with the punch rod top 13, thus reducing friction between the two surfaces.

The lower end of the punch rod 15 is sharpened to effect a clean, round perforation in the sheet when the punch rod descends into the cooperating punch die below the sheet.

The punch shown in FIG. 2 does not contain any means for restraining the punch rod in a vertical direction. The user must align the rod before punching, and then pull the punch rod out of the punch die every time the device is used. This primitive embodiment of the current invention may have commercial viability because of the simplicity and ease of manufacture of the embodiment.

Figure 5:
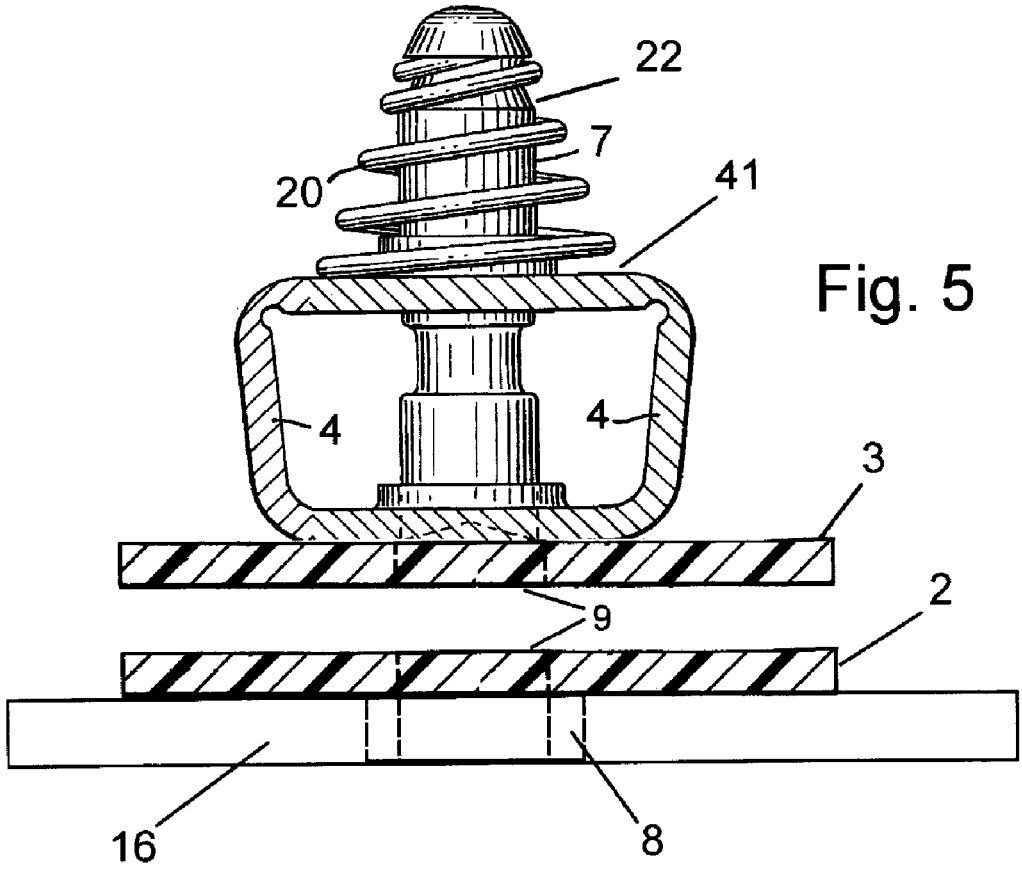
FIG. 5 depicts a front elevation view of a punch rod and supporting assembly, with a spring retainer.

An alternative embodiment, shown in FIG. 5, provides for a coil spring to restore the punch rod to an extended, or ready position in the absence of pressure from the lever handle. FIG. 5 does not show the lever arm, or other means of exerting a downward pressure on the punch rod, but may be incorporated into any of the various embodiments described herein.

Referring now to FIG. 5, the coil spring 20 is retained in place in an annular recess 22 formed in the upper part of the punch rod. The lower part of the coil spring rests on the upper surface 41 of the upper frame. When the punch rod is depressed, the coil spring compresses, exerting a restoring force in opposition to the depression force.

Variations of this embodiment may use a hole drilled through the upper part of the punch rod, and perpendicular to the long axis of the punch rod, to restrain the upper part of the coil spring of the punch rod in place of the recess shown in FIG. 5.

Also shown in FIG. 5 is the upper magnet 3, in which a clearance hole 9 is bored, so that the punch rod may descend through this clearance hole. A similar clearance hole is bored in the lower magnet 2, which is concentrically aligned with the punch die 8 in the lower assembly 16.

Thus, when a downward pressure is exerted on the top of the punch rod 7, the lower, sharpened end of the punch rod descends through the clearance hole of the upper magnet, through the paper disposed between the upper and lower assemblies, through the clearance hole in the lower magnet 2, and thence into the punch die.

Figure 6B:
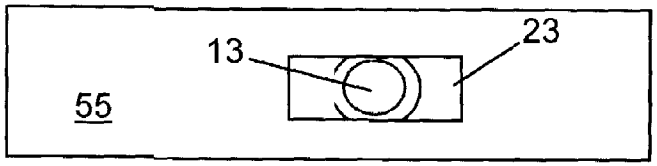
FIG. 6*b* depicts a top plan view of the lever handle internal slide assembly with captured punch rod.
Figure 6:
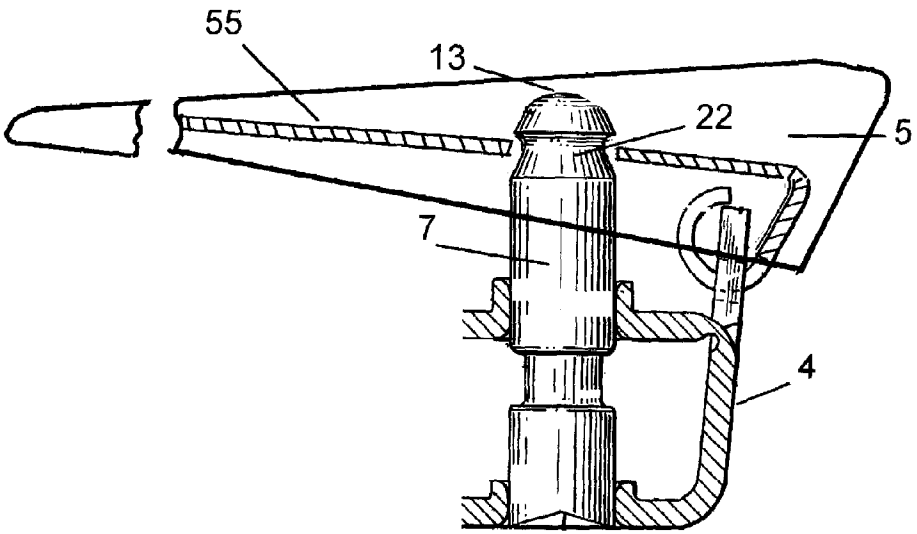
FIG. 6 depicts a front elevation view of the punch rod and supporting assembly, with a sliding captured lever handle.
Figure 7:
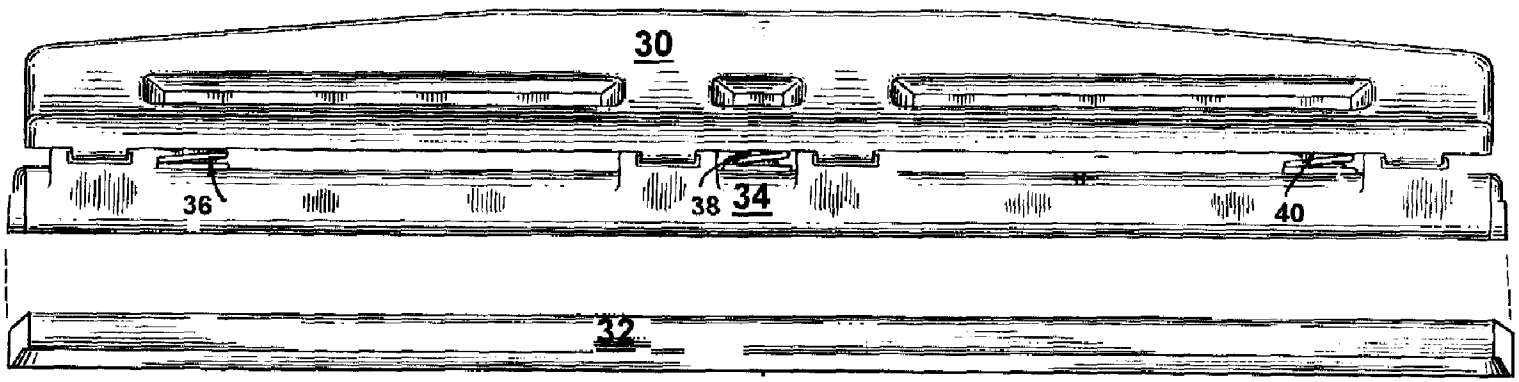
Figure 7B:
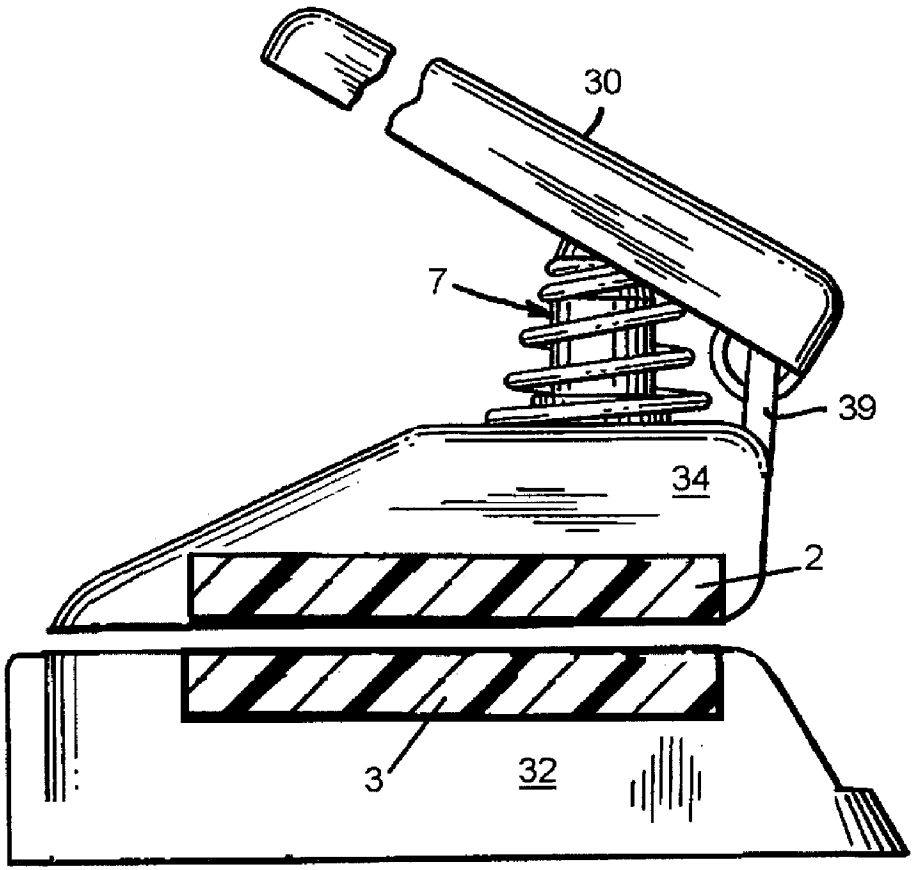

A still further embodiment is shown in FIGS. 6 and 6*b*. Referring next to this figure, the lever arm 5 contains an internal slide assembly 55, which in turn contains an oblong or rectangular opening into which the top 13 of the punch rod is inserted. The punch rod is captured by the slide assembly that engages the punch rod about the annular recess 22. The top of the punch rod is inserted into the oblong slot 23 of the slide assembly by disposing the punch rod at an angle to the slide assembly, with the top 13 of the punch rod far enough into the oblong slot 23 so that the inside edge of the oblong slot is resting against the annular recess 22. The punch rod may then be rotated into an upright position.

When the lever handle is depressed in this embodiment the punch rod will slide in one direction within the oblong slot, and will slide in the opposite direction when the handle is restored to its original position. In the embodiment shown in FIG. 6 a spring is not necessary, since the user may pull up on the lever handle to withdraw the punch rod from the sheet after completing the perforation operation.

In a still further embodiment a coil spring feature depicted in FIG. 5 may be included together with the captured slide assembly of the lever handle depicted in FIG. 6. In such an embodiment a separate, upper annular recess may be used to capture the oblong slot of the lever handle, while a second annular recess, located below the upper, annular recess, is used to retain the top of the spring. Alternatively, a hole drilled through the punch rod perpendicular to the long axis of the punch rod, and below the upper annular recess, may be used to restrain the punch rod.

Three-Hole Punch Embodiments

The present invention may be implemented in a multi-hole punch configuration in which punch rods are contained in an upper assembly, the punch dies contained in a lower assembly, and the two assemblies are aligned on opposite sides of the paper by means of magnets contained on the upper and lower assemblies, respectively.

Figure 3:
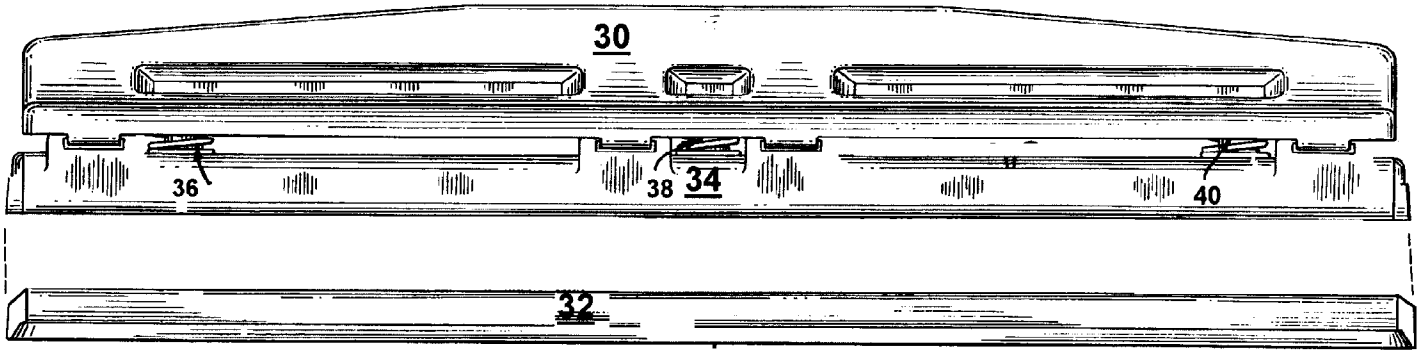
FIG. 3 depicts a perspective view of a three-hole punch embodiment of the invention.
Figure 3B:
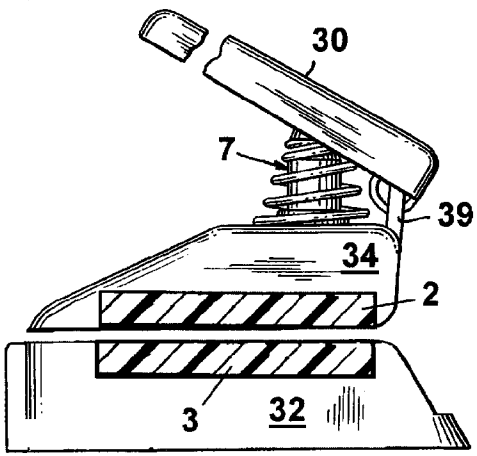
FIG. 3*b* depicts a side elevation view of the three-hole punch embodiment of the invention.

Referring now to FIGS. 3 and 3*b*, this embodiment resembles a prior-art three-hole punch, except that the upper assembly 34 is not attached to the lower assembly 32, but the two assemblies are completely separate units, not attached by any physical structural members.

The lower assembly 32 contains a lower magnet 3 inserted so that the magnet's upper surface is flush with that of the lower assembly. In a similar way the upper magnet 2 is inserted and affixed to the upper assembly 34 so that the upper magnet's lower surface is flush with the lower surface of the upper assembly.

The upper assembly contains a lever handle 30 which is rotatably hinged about hinge arm 39 so that pressure may be applied to punch rods 7, making them descend in a manner similar to the single punch embodiment described supra.

In this three-hole embodiment, there are three punch rods 7 which are similar in configuration to said single punch-rod embodiment.

Each of the three punch rods contains a spring similar to that previously described which maintains the punch rod in an extended configuration until compressed by the lever handle 30, driving the rod into the paper sheet and thence into a corresponding punch die located in the lower assembly.

While the invention has been described with reference to specific embodiments, it will be apparent that improvements and modifications may be made within the purview of the invention without departing from the scope of the invention defined in the appended claims.

What is claimed is:

1. A punching device for punching paper and like sheet material comprising:

(a) an upper frame;

(b) a cooperating upper magnetic base supporting said frame;

(c) one or more punch rods slideably disposed within the upper frame, each passing through a corresponding clearance hole formed in the upper magnetic base; and (d) a lower magnetic base further comprising a punch die corresponding to each punch rod which magnetically aligns with the upper magnetic base when said sheet material is disposed between the upper and lower magnetic bases, so that the punch may be used to perforate said sheet material anywhere on a surface of the sheet.

2. The punching device of claim 1, further comprising a lever handle rotatably affixed to the upper frame, and which slideably engages a top of each punch rod, providing a user with mechanical advantage in operating the punching device.

3. The punching device of claim 1, further comprising a lever handle rotatably affixed to the upper frame, and one or more springs, each of which exerts a restraining force to maintain the corresponding punch rod in an upper position, wherein the punch rod descends to a lower position when a superior, opposing force is applied to the top of the punch rod.

4. The punching device of claim 3 wherein one or more oblong slots is formed within the lever handle, wherein each corresponding punch rod has an annular recess formed in proximity with the top of the punch rod, with the annular recess captured within the oval slot of the lever handle, so that each punch rod will raise when the lever handle is raised, and lower when the lever handle is lowered.

5. The punching device of claims 1 or 2, wherein the number of punch-rods is one, the number of clearance holes is one, and the number of punch dies is one.

6. The punching device of claims 3 or 4, wherein the number of punch-rods is one, the number of clearance holes is one, and the number of punch dies is one.

7. The punching device of claims 1 or 2, wherein the number of punch-rods is three, the number of clearance holes is three, and the number of punch dies is three.

8. The punching device of claims 3 or 4, wherein the number of punch-rods is three, the number of clearance holes is three, and the number of punch dies is three.

9. A punching device for punching paper and like sheet material comprising:

(e) an upper frame;

(f) a cooperating upper magnetic base supporting said frame;

(g) one or more punch rods slideably disposed within the upper frame, each passing through a corresponding clearance hole formed in the upper magnetic base; and (h) a lower magnetic base, not physically connected to the upper frame or upper magnetic base, and further comprising a punch die corresponding to each punch rod which magnetically aligns with the upper magnetic base when said sheet material is disposed between the upper and lower magnetic bases, so that the punch may be used to perforate said sheet material anywhere on a surface of the sheet.

10. The punching device of claim 9, further comprising a lever handle rotatably affixed to the upper frame, and which slideably engages a top of each punch rod, providing a user with mechanical advantage in operating the punching device.

11. The punching device of claim 9, further comprising a lever handle rotatably affixed to the upper frame, and one or more springs, each of which exerts a restraining force to maintain the corresponding punch rod in an upper position, wherein the punch rod descends to a lower position when a superior opposing force is applied to the top of the punch rod.

12. The punching device of claim 11, wherein one or more oblong slots is formed within the lever handle, wherein each corresponding punch rod has an annular recess formed in proximity with the top of the punch rod, with the annular recess captured within the oval slot of the lever handle, so that each punch rod will raise when the lever handle is raised, and lower when the lever handle is lowered.

13. The punching device of claims 9 or 10, wherein the number of punch-rods is one, the number of clearance holes is one, and the number of punch dies is one.

14. The punching device of claims 11 or 12, wherein the number of punch-rods is one, the number of clearance holes is one, and the number of punch dies is one.

* * * * *